US011225728B2

(12) United States Patent
Okamoto et al.

(10) Patent No.: US 11,225,728 B2
(45) Date of Patent: Jan. 18, 2022

(54) FILM FORMING DEVICE AND METHOD FOR FORMING METAL FILM USING THE SAME

(71) Applicant: TOYOTA JIDOSHA KABUSHIKI KAISHA, Toyota (JP)

(72) Inventors: Kazuaki Okamoto, Toyota (JP); Yuuki Satou, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 91 days.

(21) Appl. No.: 16/739,370

(22) Filed: Jan. 10, 2020

(65) Prior Publication Data

US 2020/0240035 A1 Jul. 30, 2020

(30) Foreign Application Priority Data

Jan. 25, 2019 (JP) ..... JP2019-011156

(51) Int. Cl.
*C25D 17/00* (2006.01)

(52) U.S. Cl.
CPC ..... *C25D 17/002* (2013.01)

(58) Field of Classification Search
None
See application file for complete search history.

(56) References Cited

U.S. PATENT DOCUMENTS

2004/0007459 A1* 1/2004 Herchen ..... C25D 7/123 204/295
2016/0160378 A1* 6/2016 Sato ..... C25D 5/022 205/118

FOREIGN PATENT DOCUMENTS

JP 2017088918 A 5/2017

* cited by examiner

*Primary Examiner* — Louis J Rufo
(74) *Attorney, Agent, or Firm* — Dickinson Wright, PLLC

(57) ABSTRACT

A film forming device that avoids a leakage of a liquid electrolyte and a method for forming a metal film using the film forming device are provided. The film forming device to form the metal film includes an anode, a cathode, a solid electrolyte membrane disposed between the anode and the cathode, a solution container that defines a solution containing space between the anode and the solid electrolyte membrane, and a power supply that applies a voltage between the anode and the cathode. The solid electrolyte membrane includes a first surface exposed to the solution containing space and a second surface opposed to the cathode, and is dividable along a division surface having no common point with the first surface or the second surface.

3 Claims, 9 Drawing Sheets

Solid Electrolyte Membrane Attached to Nickel Film

FILM FORMING DEVICE AND METHOD FOR FORMING METAL FILM USING THE SAME

CROSS REFERENCE TO RELATED APPLICATIONS

The present application claims priority from Japanese patent application JP 2019-011156 filed on Jan. 25, 2019, the content of which is hereby incorporated by reference into this application.

BACKGROUND

Technical Field

The present disclosure relates to a film forming device for forming a metal film and a method for forming the metal film using the same.

Background Art

JP 2017-088918 A describes a device for forming a metal film, the device including an anode, a cathode (substrate), a solid electrolyte membrane disposed between the anode and the cathode, a solution chamber that contains a metal solution to bring the metal solution into contact with the anode and the solid electrolyte membrane, and a power supply that applies a voltage between the anode and the substrate. In this device, a voltage is applied between the anode and the cathode to reduce metal ions in the metal solution in a state where the solid electrolyte membrane is pressed against the substrate. This forms a metal film on a surface of the substrate.

SUMMARY

A film formation using the device as described in JP 2017-088918 A is referred to as a solid electrolyte deposition method. In the solid electrolyte deposition method, the solid electrolyte membrane adheres to the formed metal film in some cases. In these cases, an attempt to separate the metal film and the solid electrolyte membrane after the film formation sometimes causes the solid electrolyte membrane to tear and the metal solution to leak out of the solution chamber. The metal solution used in the solid electrolyte deposition method sometimes contains a strong acid and/or a deleterious substance, and therefore the leakage of such a metal solution is desirably avoided.

The present disclosure provides a film forming device that avoids a leakage of a liquid electrolyte (metal solution) containing metal ions and a method for forming the metal film using the film forming device.

According to a first aspect of the present disclosure, there is provided a film forming device for forming a metal film, the film forming device including an anode, a cathode, a solid electrolyte membrane, a solution container, and a power supply. The solid electrolyte membrane is disposed between the anode and the cathode. The solution container defines a solution containing space between the anode and the solid electrolyte membrane. The power supply applies a voltage between the anode and the cathode. The solid electrolyte membrane includes a first surface exposed to the solution containing space and a second surface opposed to the cathode. The solid electrolyte membrane is dividable along a division surface having no common point with the first surface or the second surface.

According to a second aspect of the present disclosure, there is provided a method for forming a metal film using the film forming device according to the first aspect, the method including applying a voltage between the anode and the cathode in a state where the solution containing space is filled with a liquid electrolyte containing metal ions and the solid electrolyte membrane contacts the cathode.

In the film forming device of the present disclosure, when the solid electrolyte membrane adheres to the formed metal film, an attempt to separate the metal film and the solid electrolyte membrane brings the solid electrolyte membrane divided into two pieces along the division surface. The division surface does not have any common points with the first surface exposed to the solution containing space of the solid electrolyte membrane, and this allows keeping the solution containing space sealed even when the solid electrolyte membrane is divided. Therefore, a leakage of the liquid electrolyte does not occur.

DETAILED DESCRIPTION

<Film Forming Device>

Figure 1:
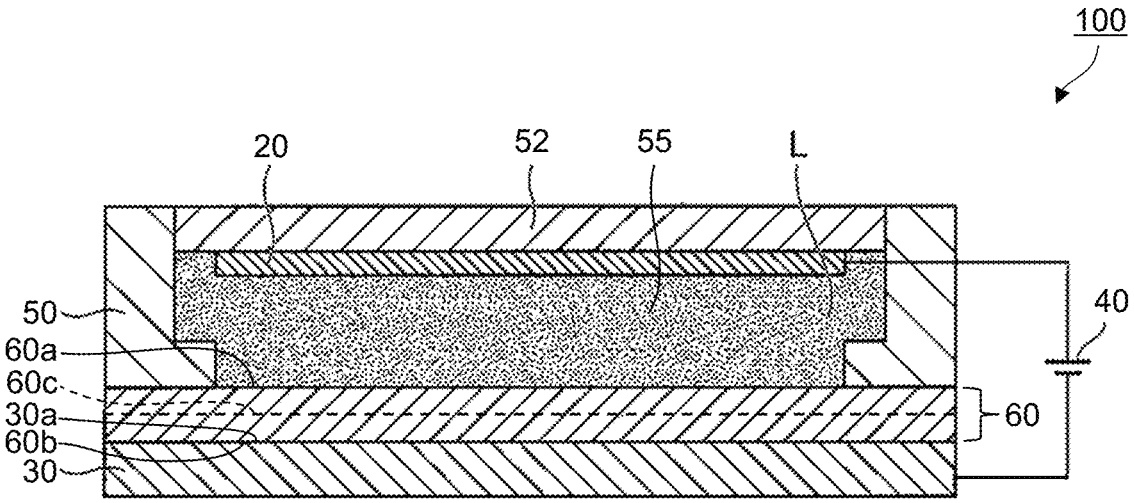
FIG. 1 is a cross-sectional view schematically illustrating an example of a film forming device.

As illustrated in FIG. 1, a film forming device 100 according to an embodiment includes an anode 20, a cathode 30, a solid electrolyte membrane 60, a solution container 50 that defines a solution containing space 55, and a power supply 40 that applies a voltage between the anode 20 and the cathode 30. The solution containing space 55 is a space to contain or hold a liquid electrolyte L containing metal ions.

(1) Anode 20

The anode 20 has a conductivity that allows the anode 20 to function as an electrode. The anode 20 may include a metal (for example, gold) having a standard oxidation-reduction potential (standard electrode potential) higher than a standard oxidation-reduction potential of the metal in the liquid electrolyte L and may be insoluble in the liquid electrolyte L. Alternatively, the anode 20 may include the same metal as a metal included in the metal film formed by the film forming device 100, and may be soluble in the liquid electrolyte L. A shape and an area of the anode 20 may be appropriately designed according to a shape and an area of a metal film forming area on a surface of the cathode 30.

(2) Cathode 30

The cathode 30 is corrosion-resistant to the liquid electrolyte L containing the metal ions and has a conductivity that allows the cathode 30 to function as an electrode. The metal film formed by the film forming device 100 is formed on a surface 30*a* of the cathode 30. For example, a substrate that includes a metal such as aluminum or iron may be employed as the cathode 30. A substrate that includes a member made of a polymer resin such as epoxy resin, ceramic, or the like and a metal film made of copper, nickel, silver, iron or the like coating the surface of the member may also be employed. In this case, the metal film, which is conductive, functions as the cathode 30. A part of the surface of the substrate may be conductive, and the conductive part functions as the cathode 30.

(3) Solid Electrolyte Membrane 60

The solid electrolyte membrane 60 is disposed between the anode 20 and the cathode 30 and is secured to the solution container 50. The solid electrolyte membrane 60 includes a first surface 60*a* exposed to the solution containing space 55 and a second surface 60*b* opposed to the cathode 30. The second surface 60*b* is a surface opposite to the first surface 60*a*. The solid electrolyte membrane 60 is dividable along a division surface 60*c* having no common point (no intersection or tangent point) with the first surface 60*a* or the second surface 60*b*. The solid electrolyte membrane 60 may be movable between a position where the solid electrolyte membrane 60 is separated from the cathode 30 and a position where the solid electrolyte membrane 60 is in contact with the cathode 30.

Figure 2:
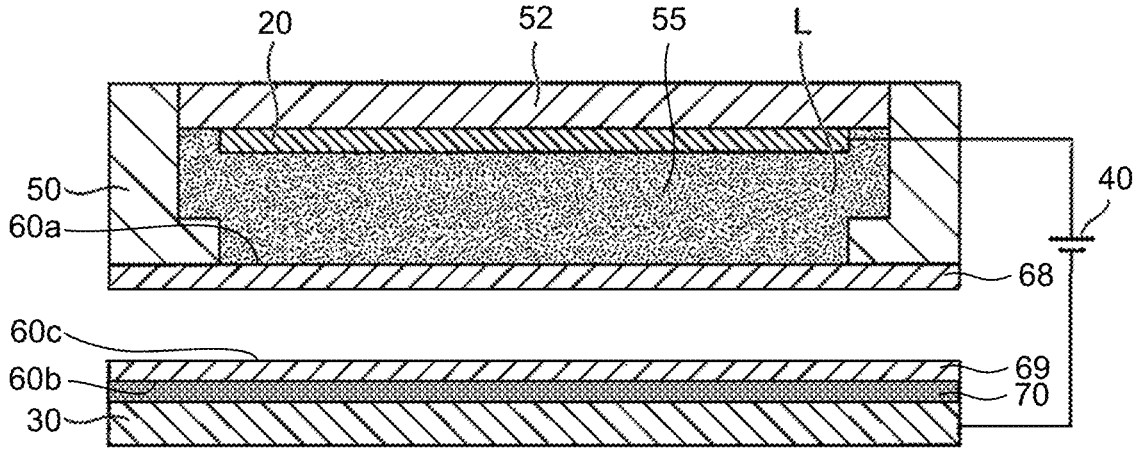
FIG. 2 is a cross-sectional view schematically illustrating an example of the film forming device where a solid electrolyte membrane is divided.

When the solution container 50 and/or the cathode 30 are attempted to be moved such that the cathode 30 and the solution container 50 are separated after the metal film is formed on the cathode 30 using the film forming device 100, the metal film strongly adheres to the second surface 60*b* of the solid electrolyte membrane 60, and the metal film and the solid electrolyte membrane 60 cannot be separated in some cases. In such cases, as illustrated in FIG. 2, the solid electrolyte membrane 60 is divided into a solution-container-side part 68 and a metal-film-side part 69 along the division surface 60*c*. The solution-container-side part 68 is secured to the solution container 50 and moves in a direction away from a metal film 70 along with the solution container 50. The metal-film-side part 69 is attached to the metal film 70 and moves in a direction away from the solution container 50 along with the cathode 30. In this application, the solid electrolyte membrane dividable into the solution-container-side part 68 and the metal-film-side part 69 along the division surface 60*c* when the metal film 70 and the solid electrolyte membrane 60 strongly adhere to each other is referred to as a solid electrolyte membrane "dividable along a division surface" in this application.

Figure 3:
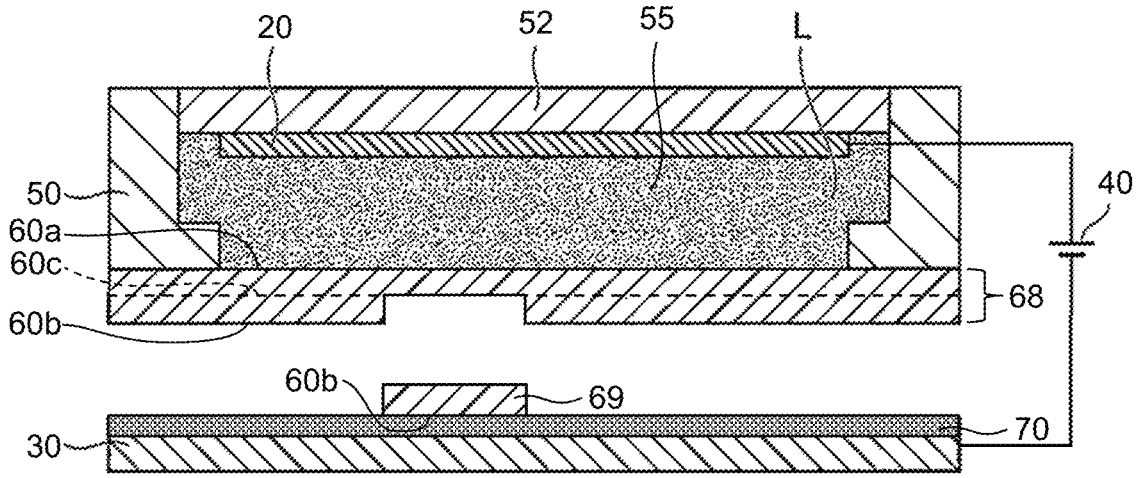
FIG. 3 is a cross-sectional view schematically illustrating another example of the film forming device where the solid electrolyte membrane is divided.

In FIG. 2, the solid electrolyte membrane 60 is divided along the whole division surface 60*c*. As illustrated in FIG. 3, the solid electrolyte membrane 60 may be divided along a part of the division surface 60*c*. Since the division surface 60*c* does not have any common points with the first surface 60*a*, the whole first surface 60*a* is included in the solution-container-side part 68 in the both cases of FIGS. 2 and 3. Therefore, even after the division of the solid electrolyte membrane 60, the solution-container-side part 68 keeps the solution containing space 55 sealed. Since the division surface 60*c* does not have any common points with the second surface 60*b*, the solution-container-side part 68 can keep the solution containing space 55 sealed even when any part of the second surface 60*b* is strongly attached to the metal film 70.

The distance between the division surface 60*c* and the second surface 60*b* may be larger than a thickness of the metal film formed by the film forming device. This allows the metal deposited inside the solid electrolyte membrane 60 to avoid extending from the second surface 60*b* to the division surface 60*c*. When the metal deposited inside the solid electrolyte membrane 60 extends from the second surface 60*b* to the division surface 60*c*, the solid electrolyte membrane 60 is not divided along the division surface 60*c* in an attempt to separate the metal film 70 and the solid electrolyte membrane 60 in some cases, which may make a hole in the solid electrolyte membrane 60. Thus, the liquid electrolyte L possibly leaks out of the solution containing space 55.

When the metal film does not strongly adhere to the second surface 60*b* of the solid electrolyte membrane 60, the solid electrolyte membrane 60 moves in a direction away from the metal film along with the solution container 50 without being divided in an attempt to move the solution container 50 and/or the cathode 30 such that the distance between the cathode 30 and the solution container 50 increases.

Figure 4:
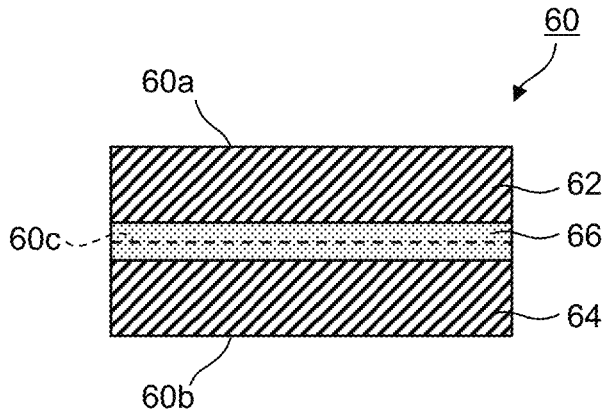
FIG. 4 is a cross-sectional view schematically illustrating an example of a layer configuration of the solid electrolyte membrane.

FIG. 4 illustrates an example of a layer configuration of the solid electrolyte membrane 60. In the solid electrolyte membrane 60 of FIG. 4, a first solid electrolyte layer 62, a porous layer 66, and a second solid electrolyte layer 64 are layered in this order. The first solid electrolyte layer 62 includes the first surface 60*a* exposed to the solution containing space 55, and the second solid electrolyte layer 64 includes the second surface 60*b* opposed to the cathode 30. The porous layer 66 has a rupture strength lower than those of the first solid electrolyte layer 62 and the second solid electrolyte layer 64. Therefore, the solid electrolyte membrane 60 is dividable along the division surface 60*c* that extends inside the porous layer 66. The division surface 60*c* may extend along an interface between the porous layer 66 and the first solid electrolyte layer 62 and/or an interface between the porous layer 66 and the second solid electrolyte layer 64.

The first solid electrolyte layer 62 and the second solid electrolyte layer 64 include a metal-ion permeable polymer membrane (ion-exchange membrane). The first solid electrolyte layer 62 and the second solid electrolyte layer 64 may include the same kind of ion exchange membrane, or may include different kinds of ion exchange membrane.

The material included in the porous layer 66 is not specifically limited. It is only required that the porous layer 66 is metal-ion permeable and has the rupture strength lower than those of the first solid electrolyte layer 62 and the second solid electrolyte layer 64.

The solid electrolyte membrane 60 as illustrated in FIG. 4 can be manufactured by, for example, a multi-layer co-extrusion method. Specifically, the solid electrolyte membrane 60 can be manufactured as follows. Raw material resins of the first solid electrolyte layer 62, the porous layer 66, and the second solid electrolyte layer 64 are heated to melt and are each extruded from an extruder to be supplied to a T-Die. A multi-layer melt film including layers of the respective molten resins is discharged from the T-Die, and the multi-layer melt film is brought into contact with a cooling roll to be cooled and hardened.

The layer configuration of the solid electrolyte membrane 60 is not limited to the above-described example. For example, the solid electrolyte membrane 60 may have yet another layer. The solid electrolyte membrane 60 can be manufactured by attaching an ion exchange membrane to another ion exchange membrane with an adhesiveness enhanced by any surface treatment for increasing the surface energy. In this case, an interface of the two ion exchange membranes becomes the division surface 60*c*. The solid electrolyte membrane 60 can be manufactured by bonding two ion exchange membranes via a metal-ion permeable middle layer having a lower rupture strength.

(4) Solution Container 50

The solution container 50 usually has a hollow columnar shape having openings in its upper portion and lower portion. The solid electrolyte membrane 60 is disposed so as to cover the opening in the lower portion of the solution container 50, and a lid 52 is disposed so as to cover the opening in the upper portion of the solution container 50. The anode 20 is disposed between the solid electrolyte membrane 60 and the lid 52 separated from the solid electrolyte membrane 60. Thus, the solution containing space 55 is defined between the anode 20 and the solid electrolyte membrane 60. The solution container 50 holds the liquid electrolyte L containing the metal ions. While the anode 20 is in contact with the lid 52 in FIG. 1, the anode 20 and the lid 52 may be separated. In this case, the liquid electrolyte L may be also provided between the anode 20 and the lid 52.

The liquid electrolyte L contains the metal, which is the same as a metal included in the metal film to be formed by the film forming device 100, in an ion state. Examples of the type of the metal include copper, nickel, silver, and iron.

(5) Power Supply 40

The power supply 40 is electrically connected to the anode 20 and the cathode 30. The power supply 40 generates an electric potential difference between the anode 20 and the cathode 30.

<Method for Forming Metal Film>

The following describes the method for forming the metal film using the film forming device 100 (see FIG. 1).

The solution containing space 55 in the film forming device 100 is filled with the liquid electrolyte L containing the metal ions. The solid electrolyte membrane 60 is brought into contact with the cathode 30. In this state, a voltage is applied between the anode 20 and the cathode 30 by the power supply 40. The metal ions in the liquid electrolyte L move in a direction from the anode 20 to the cathode 30 through the solid electrolyte membrane 60. The metal ions reach the interface (surface) 30*a* between the solid electrolyte membrane 60 and the cathode 30 and are reduced to turn into metal deposit. Thus, the metal film is formed on the cathode 30.

When the voltage is applied, the pressure in the solution containing space 55 may be increased, and this facilitates impregnating the solid electrolyte membrane 60 with the liquid electrolyte L in the solution containing space 55. The increased pressure in the solution containing space 55 has a problem that a tear of the solid electrolyte membrane 60 immediately causes the liquid electrolyte L to leak out of the solution containing space 55. However, since in the film forming device 100 of the embodiment, the solution-container-side part 68 of the solid electrolyte membrane 60 can keep the solution containing space 55 sealed with certainty, such a problem can be solved. The pressure in the solution containing space 55 can be increased with, for example, a high pressure pump (not illustrated) connected to the solution containing space 55.

Afterwards, the solid electrolyte membrane 60 is attempted to be separated from the formed metal film. When the film formation is normally performed, the metal film and the solid electrolyte membrane 60 can be separated without any problems. In case of a failure in the film formation, the metal film 70 (see FIGS. 2 and 3) and the solid electrolyte membrane 60 strongly adhere in some cases. In this case, as illustrated in FIGS. 2 and 3, the solid electrolyte membrane 60 is divided into the solution-container-side part 68 and the metal-film-side part 69 along the division surface 60*c*. Since the solution-container-side part 68 keeps the solution containing space 55 sealed, the liquid electrolyte L does not leak out of the solution containing space 55. Afterwards, the liquid electrolyte L is removed from the solution containing space by a predetermined method, and the solid electrolyte membrane 60 is replaced. When the film formation is normally performed, the solid electrolyte membrane 60 does not need replacing.

Besides, various film forming conditions such as the applied voltage may be appropriately set depending on an area on which the film is to be formed, a targeted film thickness, and the like. To improve a throughput of the film formation, it is desired that the film formation is performed under a high current density. According to examinations by the inventors, performing the film formation under the high current density is prone to occurrence of the adhesion of the metal film 70 and the solid electrolyte membrane 60. The film forming device of the embodiment can keep the solution containing space sealed even when the metal film 70 and the solid electrolyte membrane 60 adhere to each other and the solid electrolyte membrane is divided into two pieces. Therefore, the film forming device of the embodiment allows the metal film being formed safely with high throughput.

While the embodiment of the present disclosure has been described in detail above, the present disclosure is not limited thereto, and can be subjected to various kinds of changes in design without departing from the spirit of the present disclosure described in the claims.

EXAMPLES

While the following further specifically describes the present disclosure through an example and a comparative example, the present disclosure is not limited to this example.

Example (1) Manufacturing Solid Electrolyte Membrane

A solid electrolyte membrane including a first solid electrolyte layer having a thickness of 5 μm, a porous layer, and a second solid electrolyte layer having a thickness of 25 μm that were layered in this order was manufactured by the multi-layer co-extrusion method. Specifically, raw material resins of the first solid electrolyte layer, the porous layer, and the second solid electrolyte layer were heated to melt and were each extruded from an extruder to be supplied to the T-Die. A multi-layer melt film including layers of the respective molten resins was discharged from the T-Die, and the multi-layer melt film was brought into contact with the cooling roll to be cooled and hardened.

(2) Forming Nickel Film

On a silicon wafer having a diameter of 50 mm and a thickness of 280 μm, a titanium film having a thickness of 80 nm and a copper film having a thickness of 300 nm were formed in this order. The silicon wafer with the titanium film and the copper film was used as a substrate (cathode), and a foamed nickel (manufactured by Nilaco Corporation) was used as an anode. The substrate and the anode were oppositely disposed. The solid electrolyte membrane was disposed between the substrate and the anode. At this time, the second solid electrolyte layer of the solid electrolyte membrane was brought into contact with the substrate. A space between the solid electrolyte membrane and the anode was filled with a nickel solution. The nickel solution was an aqueous solution (pH 4.0) containing 1 mol/L of nickel chloride and 0.05 mol/L of nickel acetate as a buffer. Thus, the film forming device as illustrated in FIG. 1 was constituted.

A temperature of the substrate was set to 60° C., and a pressure of a solution containing space was set to 1 MPa. A current was flown for 90 seconds between the cathode and the anode. This caused the nickel to deposit on the substrate to form a nickel film. A film forming area was prepared to have a size of 15×15 mm. A film forming rate was 2 μm/minute. After the film formation, the solid electrolyte membrane was attempted to be separated from the nickel film.

A plurality of the nickel films were formed on a plurality of substrates respectively as described above. The nickel solution did not leak out of the solution containing space when the solid electrolyte membrane was attempted to be separated from the nickel film in any case.

(3) Observation of Solid Electrolyte Membrane after Film Formation

Figure 5:
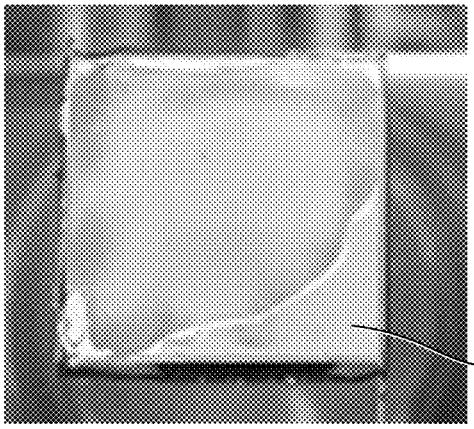
FIG. 5 is a photograph of a nickel film, which was formed in an example, with a part of the solid electrolyte membrane attached to the nickel film.
Figure 6:
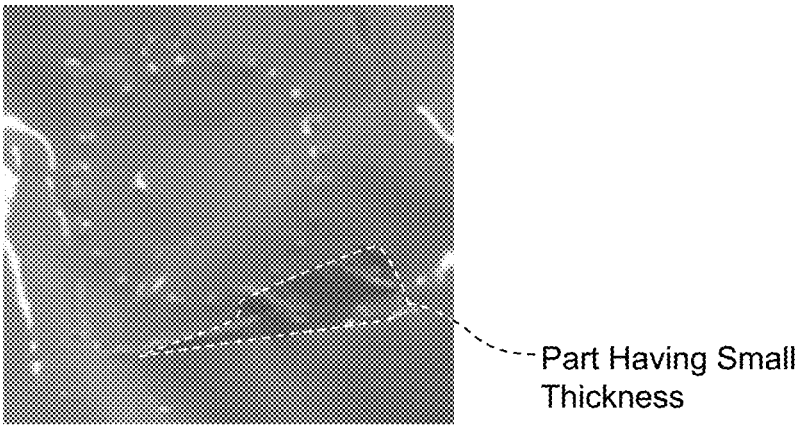
FIG. 6 is a photograph of the solid electrolyte membrane after being used for forming the nickel film of FIG. 5.
Figure 7:
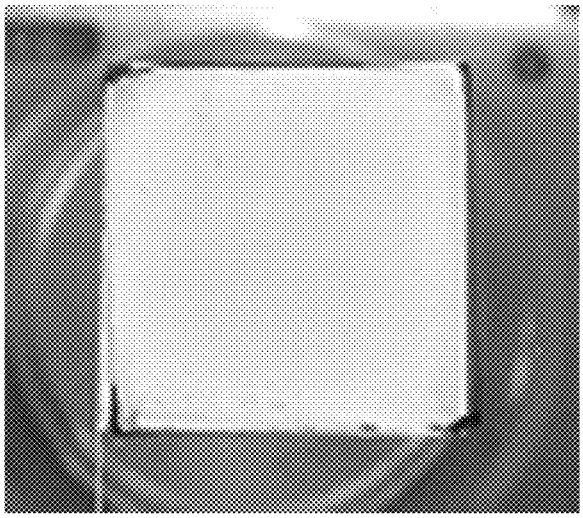
FIG. 7 is a photograph of the nickel film, which was formed in the example, without any parts of the solid electrolyte membrane attached to the nickel film.
Figure 8:
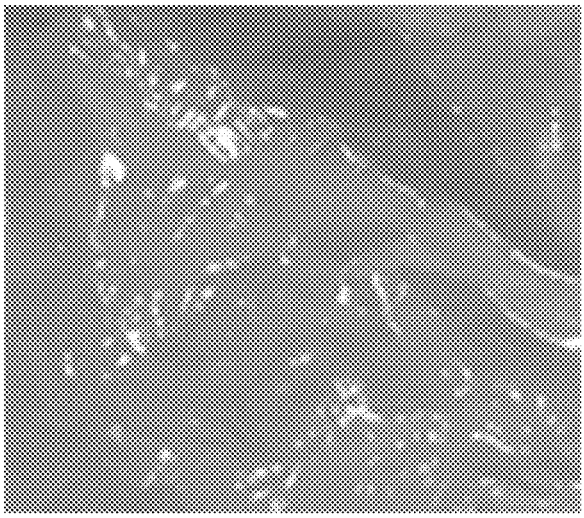
FIG. 8 is a photograph of the solid electrolyte membrane after being used for forming the nickel film of FIG. 7.

Parts of the solid electrolyte membrane were attached to some of the plurality of formed nickel films. FIG. 5 illustrates a photograph of the nickel film to which a part of the solid electrolyte membrane is attached. FIG. 6 illustrates a photograph of the post-use solid electrolyte membrane used when a part of the solid electrolyte membrane was attached to the nickel film. Although the solid electrolyte membrane after the use had a part having a small thickness, the solid electrolyte membrane did not have a tear (hole) that penetrates through the solid electrolyte membrane in a thickness direction. It is considered that the solid electrolyte membrane was partially divided into the first solid electrolyte layer and the second solid electrolyte layer along a line in the porous layer, and the separated part of the second solid electrolyte layer was attached to the nickel film when the solid electrolyte membrane was attempted to be separated from the nickel film. A hole was not made on the first solid electrolyte layer, and this kept the solution containing space sealed. Therefore, the nickel solution did not leak out. FIG. 7 illustrates a photograph of a nickel film to which the solid electrolyte membrane is not attached, and FIG. 8 illustrates a photograph of the post-use solid electrolyte membrane used for forming the nickel film of FIG. 7. The solid electrolyte membrane after the use did not have a part having a small thickness, and the thickness before the use was kept.

Comparative Example (1) Forming Nickel Film

On a glass substrate of 50 mm×40 mm, a copper film having a thickness of 300 nm was formed by sputtering. The glass substrate with the copper film was used as a substrate (cathode), and a pure nickel foil (manufactured by Nilaco Corporation) having a thickness of 0.05 mm was used as an anode. The substrate and the anode were oppositely disposed. A commercially available solid electrolyte membrane (Nafion manufactured by DuPont) was disposed between the substrate and the anode to bring the solid electrolyte membrane into contact with the substrate. A space between the solid electrolyte membrane and the anode was filled with the same nickel solution as the nickel solution used in the example.

A temperature of the substrate was set to 80° C., and a pressure of a solution containing space was set to 0.5 MPa. A current was flown between the cathode and the anode. This caused the nickel to deposit on the substrate to form a nickel film. A film forming area was prepared to have a size of 5×5 mm. A film forming rate was 2 μm/minute. After the film formation, the solid electrolyte membrane was attempted to be separated from the nickel film.

A plurality of the nickel films were formed on a plurality of substrates respectively as described above. The nickel solution leaked out of the solution containing space when the solid electrolyte membrane was attempted to be separated from the nickel film in some cases.

(2) Observation of Solid Electrolyte Membrane after Film Formation

Figure 9:
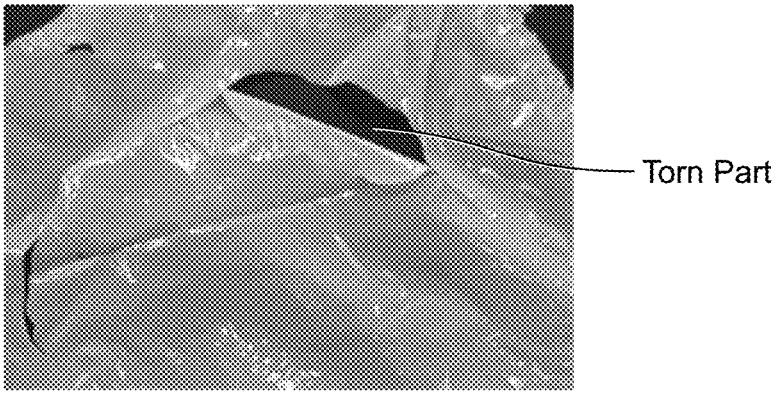
FIG. 9 is a photograph of a solid electrolyte membrane after use in a case where a nickel solution leaks out of a solution containing space in a comparative example.

FIG. 9 illustrates a photograph of the post-use solid electrolyte membrane used when the nickel solution leaked out of the solution containing space. On the solid electrolyte membrane, a tear was made. It is considered that the solid electrolyte membrane tore to make the hole penetrating through the solid electrolyte membrane in the thickness direction when the solid electrolyte membrane was attempted to be separated from the nickel film, and thus the nickel solution passed through the hole and leaked out of the solution containing space.

DESCRIPTION OF SYMBOLS

20 Anode
30 Cathode
40 Power supply
50 Solution container
55 Solution containing space
60 Solid electrolyte membrane
60*a* First surface
60*b* Second surface
60*c* Division surface
62 First solid electrolyte layer
64 Second solid electrolyte layer
66 Porous layer
100 Film forming device
L Liquid Electrolyte

What is claimed is:

1. A film forming device for forming a metal film, the film forming device comprising:

an anode;

a cathode;

a solid electrolyte membrane disposed between the anode and the cathode;

a solution container that defines a solution containing space between the anode and the solid electrolyte membrane; and a power supply that applies a voltage between the anode and the cathode, wherein the solid electrolyte membrane includes a first surface exposed to the solution containing space and a second surface opposed to the cathode, and the solid electrolyte membrane is dividable along a division surface having no common point with the first surface or the second surface;

wherein the solid electrolyte membrane comprises:

a first solid electrolyte layer and a second solid electrolyte layer, and wherein the division surface extends between the first solid electrolyte layer and the second solid electrolyte layer, and a layer between the first solid electrolyte layer and the second solid electrolyte layer, the layer having a rupture strength lower than those of the first solid electrolyte layer and the second solid electrolyte layer.

2. A method for forming a metal film using the film forming device as defined in claim 1, the method comprising applying a voltage between the anode and the cathode in a state where the solution containing space is filled with a liquid electrolyte containing metal ions and the solid electrolyte membrane contacts the cathode.

3. The film forming device of claim 1, wherein the solid electrolyte membrane is movable between a position where the solid electrolyte membrane is separated from the cathode and a position where the solid electrolyte membrane is in contact with the cathode.

* * * * *